US007125457B2

(12) United States Patent
Kool et al.

(10) Patent No.: US 7,125,457 B2
(45) Date of Patent: Oct. 24, 2006

(54) METHOD FOR REMOVING OXIDE FROM CRACKS IN TURBINE COMPONENTS

(75) Inventors: Lawrence Bernard Kool, Clifton Park, NY (US); Ann Melinda Ritter, Niskayuna, NY (US); Laurent Cretegny, Niskayuna, NY (US); Mark Dean Pezzutti, Simpsonville, SC (US); Stewart William Beitz, Greenville, SC (US)

(73) Assignee: General Electric Company, Schenectady, NY (US)

( * ) Notice: Subject to any disclaimer, the term of this patent is extended or adjusted under 35 U.S.C. 154(b) by 185 days.

(21) Appl. No.: 10/749,486

(22) Filed: Dec. 31, 2003

(65) Prior Publication Data

US 2005/0139236 A1 Jun. 30, 2005

(51) Int. Cl.

| | |
|---|---|
| ***C23G 1/00*** | (2006.01) |
| ***B08B 7/04*** | (2006.01) |
| ***B08B 3/04*** | (2006.01) |

(52) U.S. Cl. ..... 134/2; 134/3; 134/19; 134/21; 134/26

(58) Field of Classification Search ..... 134/2, 134/19, 21, 26, 42, 3

See application file for complete search history.

(56) References Cited

U.S. PATENT DOCUMENTS

| | | | | |
|---|---|---|---|---|
| 6,019,806 | A * | 2/2000 | Sees et al. | 51/308 |
| 6,379,749 | B1 * | 4/2002 | Zimmerman, Jr. et al. | 427/307 |
| 6,599,416 | B1 | 7/2003 | Kool et al. | |
| 2003/0083213 | A1 | 5/2003 | Kool et al. | |

* cited by examiner

*Primary Examiner*—Michael Barr
*Assistant Examiner*—Saeed T. Chaudhry
(74) *Attorney, Agent, or Firm*—Cantor Colburn LLP

(57) ABSTRACT

A method for removing an oxide material from a crack in a substrate, the method includes: applying a slurry paste comprising a fluoride salt to the crack; heating the slurry paste and the crack to at least a melting point of the fluoride salt to form a reaction product; and removing the reaction product.

25 Claims, 3 Drawing Sheets

METHOD FOR REMOVING OXIDE FROM CRACKS IN TURBINE COMPONENTS

BACKGROUND OF THE INVENTION

This disclosure relates to a method for removing oxide from a turbine component, and more particularly, for removing oxide formed in cracks of the turbine component.

Metal alloys are often used in industrial environments, which include extreme operating conditions. As an example, gas turbine engines are often subjected to repeated thermal cycling during operation. The standard operating temperature of turbine engines continues to be increased, to achieve improved fuel efficiency. The turbine engine components (and other industrial parts) are often formed of superalloys, which can withstand a variety of extreme operating conditions.

In addition, turbine components, e.g., gas turbine airfoils, can develop cracks. During service, these cracks are often exposed to oxidizing conditions. Under such conditions, which often include temperatures in the range of about 1400–2100° F. (about 760–1149° C.), various oxidized products (mainly thermally-grown oxide or "TGO") are formed on and within the cracks.

When turbine engine components are overhauled, the cracks are repaired. A conventional method for repairing these cracks is a brazing procedure known as Activated Diffusion Healing ("ADH"). However, in order to perform this repair procedure, the oxide in the crack must be completely removed since oxides, in particular aluminum, titanium, and chromium oxides, prevent wetting of the alloy surface by the braze material.

The conventional method for cleaning the oxide from the cracks is known as "fluoride ion cleaning" ("FIC"), which is a high temperature gas-phase treatment of the component with hydrogen fluoride and hydrogen gas. The FIC method has certain drawbacks because the equipment is expensive to purchase, operate, and maintain. In addition, hydrogen fluoride is a hazardous chemical and thus, it is desirable to develop an alternative method for cleaning oxide from the cracks in gas turbine airfoils.

SUMMARY OF THE INVENTION

An exemplary embodiment of the invention is directed to a method for removing an oxide material from a crack in a substrate. The method includes: applying a slurry paste comprising a fluoride salt to the crack; heating the slurry paste and the crack to at least the melting point of the fluoride salt to form a reaction product; and removing the reaction product. Another exemplary embodiment of the invention is a method of removing oxide from a crack in a substrate, the method includes: reacting oxide in the crack by a molten fluoride salt to form a reaction product; and immersing the crack in a water bath to remove oxide. Another exemplary embodiment of the invention is a method of removing oxide from a crack in a substrate, the method includes: applying a slurry paste to the crack, wherein the slurry paste comprises a fluoride salt; applying a vacuum to the crack; heating the slurry paste and the crack to at least a melting point of the fluoride salt to form a reaction product; and removing the reaction product.

Further details regarding the various features of this invention are found in the remainder of the specification.

DETAILED DESCRIPTION OF THE INVENTION

Figure 1:
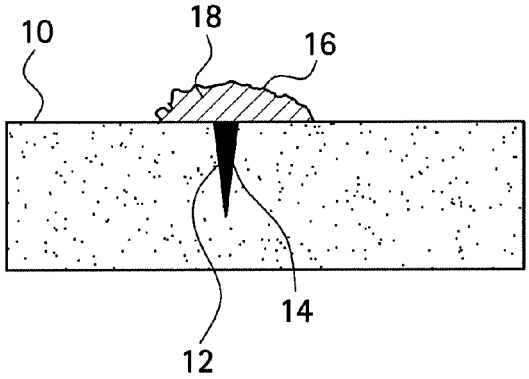
FIG. 1 is a cross-sectional view of crack with oxide in a gas turbine airfoil with an aqueous slurry of a fluoride salt having been applied.
Figure 2:
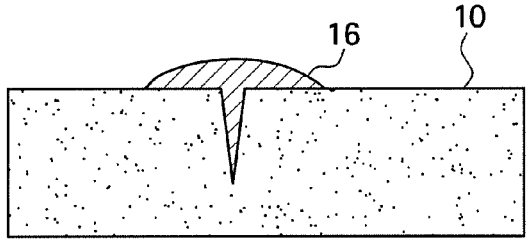
FIG. 2 is a cross-sectional view of the aqueous slurry of FIG. 1 reacting with the oxide in the crack.
Figure 3:
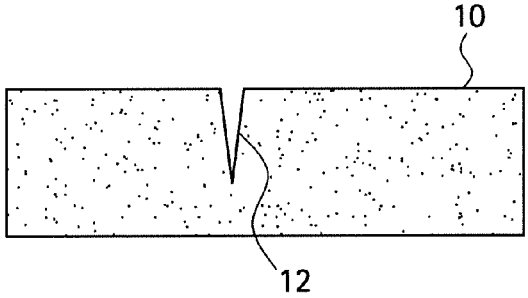
FIG. 3 is a cross-sectional view of the crack of FIG. 1 in which the oxide has been removed.

FIGS. 1–3 illustrate an exemplary embodiment of a method to remove oxide from a crack in a substrate, which includes substrates used for gas turbine airfoils. Usually, the substrate is a metallic material. As used herein, "metallic" refers to substrates which are primarily formed of metal or metal alloys, but which may also include some non-metallic components. Non-limiting examples of metallic materials are those which comprise at least one element selected from the group consisting of iron, cobalt, nickel, aluminum, chromium, titanium, and mixtures which include any of the foregoing (e.g., stainless steel).

Very often, the metallic material is a superalloy, which is typically nickel-, cobalt-, or iron-based, although nickel- and cobalt-based alloys are favored for high-performance applications. The base element, typically nickel or cobalt, is the single greatest element in the superalloy by weight. Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel®, Nimonic®, and René®, and include equiaxed, directionally solidified and single crystal superalloys. Illustrative cobalt-base superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Udimet®.

As used herein, the term "oxide" and/or "oxide material" is generally meant to include the oxidized product or products of a crack of a substrate. In most cases (but not always), the oxide material is formed in the crack after it has been exposed in air to the elevated temperatures mentioned above, i.e., about 1400° F. (760° C.) to about 2100° F. (1149° C.). As an example, the surface of a nickel-based substrate exposed in air to elevated temperatures for extended periods of time will at least partially be transformed into various metal oxides (depending on the substrate's specific composition), such as aluminum oxide, chromium oxide, nickel oxide, cobalt oxide, and yttrium oxide. Various spinels may also form, such as $Ni(Cr,Al)_2O_4$ spinels and $Co(Cr,Al)_2O_4$ spinels.

The thickness of the oxide material will depend on a variety of factors. These include the length of service time for the component; its thermal history; and the particular composition of the substrate. Usually a layer of oxide material has a thickness in the range of about 0.5 micron to about 20 microns, and most often, in the range of about 1 micron to about 10 microns, which can sometimes fill a crack in a gas turbine airfoil.

FIG. 1 illustrates a substrate 10, such as a gas turbine airfoil, having a crack 12 filled with oxide 14. An aqueous slurry of fluoride salt 16 ("slurry paste 16") is applied to a surface 18 of substrate 10 along crack 12. The slurry paste 16 is a combination of the fluoride salt mixed with water. Only a small amount of slurry paste 16 is necessary, as only the local region of crack 12 receives slurry paste 16. Slurry paste 16 is applied by any known method including a syringe, a micropipet, a pressurized delivery system, a pneumatic dispenser, and the like.

The fluoride salt of slurry paste 16 includes all alkali metal and alkaline earth metals and also includes all of combination of elements set forth in Table 1, below. In an exemplary embodiment, fluoride salt is potassium tetrafluoroaluminate, potassium tetrafluoroborate, sodium tetrafluoroaluminate, sodium tetrafluoroborate and the like. The common denominator of each of the combinations set forth in Table 1 is that the combination of elements is at least partly soluble in water.

TABLE 1

| Salt Nam | Salt Formula | mp (° C.) |
|---|---|---|
| ammonium difluophosphate | $NH_4PO_2F_2$ | 213 |
| ammonium fluosulfonate | $NH_4SO_3F$ | 245 |
| ammonium hydrogen fluoride | $NH_4HF_2$ | 1256 |
| barium fluosilicate | $BaSiF_6$ | d 300 |
| calcium fluoride | $CaF_2$ | 703 |
| cerium(III) fluoride | $CeF_3$ | 1460 |
| cerium(IV) fluoride | $CeF_4$ | 650 |
| cesium fluoride | CsF | 682 |
| cesium fluoride hydrate | $CsF.1½H_2O$ | 703 |
| cobalt(II) fluoride | $CoF_2$ | 1200 |
| copper(I) fluoride | CuI | 908 |
| lithium fluoride | LiF | 845 |
| lithium fluosulfonate | $LiSO_3F$ | 360 |
| magnesium fluoride | $MgF_2$ | 1261 |
| manganese difluoride | $MnF_2$ | 856 |
| molybdenum oxytetrafluoride | $MoOF_4$ | 98 |
| potassium acid fluoride | $KHF_2$ | 225 |
| potassium fluoborate | $KBF_4$ | d 350 |
| potassium fluogermanate | $K_2GeF_6$ | 730 |
| potassium fluoride | KF | 858 |
| potassium fluoride hydrate | $KF2H_2O$ | 41 |
| potassium fluosulfonate | $KFSO_3$ | 311 |
| potassium hexafluorophosphate | $KPF_4$ | 575 |
| silver difluoride | $AgF_2$ | 690 |
| silver fluoride | AgF | 435 |
| sodium fluoborate | $NaBF_4$ | 384 |
| sodium fluorophosphate | $NaPO_3F$ | 625 |
| tantalum fluoride | $TaF_5$ | 96.8 |
| thallium fluoride | TlF | 327 |
| zinc fluoride | $ZnF_2$ | 872 |

The slurry paste 16 may also include various other additives, which serve a variety of functions, such as lowering the viscosity of the paste so that the paste penetrates the crack, etc. Non-limiting examples of these additives are inhibitors, dispersants, surfactants, chelating agents, wetting agents, deflocculants, stabilizers, anti-settling agents, reducing agents, and anti-foam agents. Those of ordinary skill in the art are familiar with specific types of such additives, and with effective levels for their use.

As shown in FIG. 2, after slurry paste 16 is applied to crack 12, slurry paste 16 penetrates a portion of crack 12 that is open. To enhance the penetration, substrate 10 is cycled through a rough vacuum (or any such equipment that removes the air from the crack) that causes trapped air to leave crack 12. When substrate 10 is removed from the rough vacuum and is exposed to atmospheric pressure, slurry paste 16 is pushed into the air-evacuated crack. Penetration can also be accomplished by the method in which the slurry paste is applied. Slurry paste 16 is then dried.

Once slurry paste 16 has dried, substrate 10 is placed in an inert atmosphere, such as argon or in vacuum. Substrate 10 is then subjected to a temperature, which is at least the melting point or higher than the melting point of the fluoride salt in slurry paste 16 to form a molten fluoride salt. The slurry paste reacts with oxide 14 in crack 12 to form a water soluble and/or water removable reaction product.

The reaction product is then removed by immersing substrate 10 in a water bath. A small of amount of acid may be added to the water bath in order to bring the water bath into the pH range of about 1 to 6, with a preferred pH range of about 2 to 3. In an exemplary embodiment, the water bath has a temperature ranging from approximately room temperature and above. The reaction product may be the oxide "dissolving" and it may also be a "chemical reaction." In addition, the terms dissolving and chemical reaction are used interchangeably and are all meant to encompass the reaction that occurs between the slurry paste and oxide.

While not wanting to be bound by the theory, for oxides of aluminum one possible chemical reaction that could occur between the slurry paste and the oxide is as follows:

$$Al_2O_3 + nKAlF_4 \longrightarrow [K_nAl_{n+2}O_3F_{4n}]$$

$$\downarrow H_2O, H^+$$

$$(n+2)Al^{3+} + 4nF^- + nK^+ + 6H_2O$$

Figure 4:
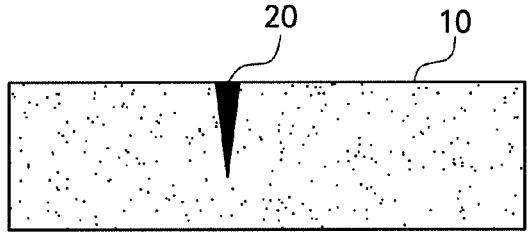
FIG. 4 is a cross-sectional view of the crack after it has been repaired.

FIG. 3 illustrates crack 12, which is substantially free of oxide. As shown in FIG. 4, once the oxide has been removed from crack 12, crack 12 can be repaired by any known method, such as brazing, and the like, leaving a repaired crack 20.

Figure 5:
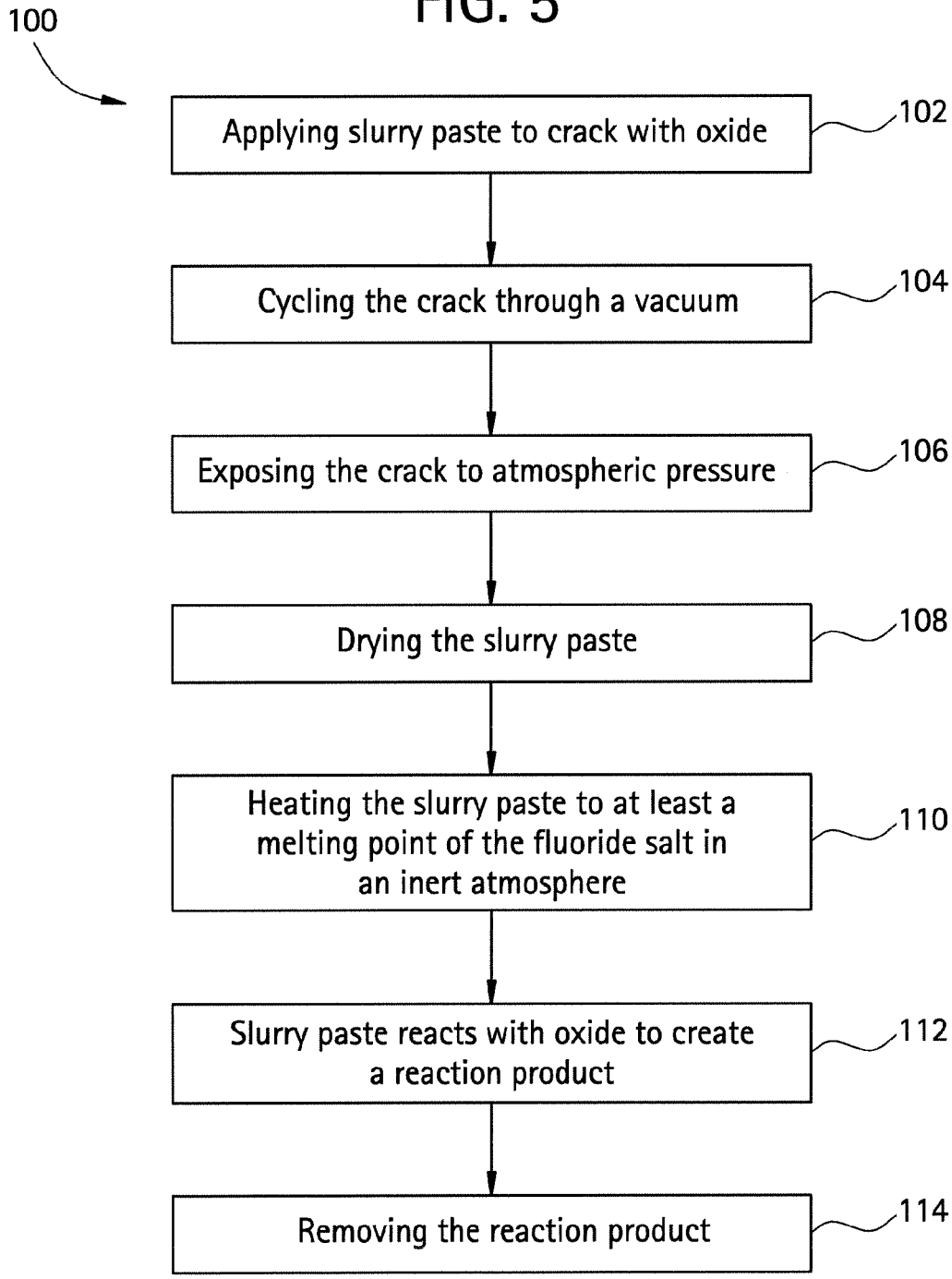
FIG. 5 is box diagram of a method of removing an oxide from a crack in a gas turbine airfoil.

FIG. 5 illustrates an exemplary embodiment of a method of removing oxide from a crack in a gas turbine airfoil 100. At step 102, the slurry paste is applied to the crack with the oxide. At steps 104 and 106, the gas turbine airfoil is cycled through a vacuum and subsequently exposed to atmospheric pressure, thereby removing air from the crack. Steps 104 and 106 cause the slurry paste to penetrate the crack and to move in and around the oxide in the crack. At step 108, the slurry paste is dried.

At step 110, the slurry paste is heated in an inert atmosphere to at least a melting point of the fluoride salt and in an exemplary embodiment above the melting point of the fluoride salt. At step 112, once the fluoride salt reaches the melting point, the molten slurry paste reacts with oxide to create a reaction product. At step 114, the reaction product is removed by immersing the gas turbine airfoil in a water bath.

Advantageously, the method eliminates the requirements dictated by the only other known method, fluoride ion cleaning ("FIC"). As previously discussed, FIC requires expensive equipment and uses hydrogen fluoride, which is a hazardous chemical and environmentally unfriendly; thus, by using the method disclosed herein the method eliminates the need to have storage of hydrogen fluoride on site. It also avoids the capital expense of a FIC retort and related environmental controls.

In addition, the FIC process exposes the entire substrate to potentially damaging conditions that could lead to base-metal attack. The method disclosed herein subjects the local, cracked regions of the substrate to the oxide removing reactive chemistry; thus, it presents less risk of damaging the base alloy because the corrosive action of the cleaning agent only occurs where the slurry paste is locally applied.

Moreover, the disclosed method uses the existing equipment that would be found in a repair shop (e.g., vacuum furnaces or argon furnaces, braze-slurry application equipment). The method may also use the Activated Diffusion Healing ("ADH") vacuum furnace, which is used in the brazing process to repair the crack, to heat the fluoride salt. Thus, additional equipment is not necessary to complete this method. The method is effective because it removes the oxide, which allows the cracks to be repaired by ADH brazing.

The example that follows is merely illustrative, and should not be construed to be any sort of limitation on the scope of the claimed invention.

EXAMPLE 1

A substrate formed of GTD-222, a Ni-based superalloy, was cut into three samples and the samples were ground down to remove the recast layer produced by electric discharge machining. The samples were oxidized in an air furnace for 48 hours at 2250° F. Potassium tetrafluoroaluminate was applied to a first sample and potassium tetrafluoroborate was applied to a second sample. Both samples were then heated to 580° C. for one hour. Both samples were then rinsed in a water bath and the oxide was removed from both samples.

Figure 6:
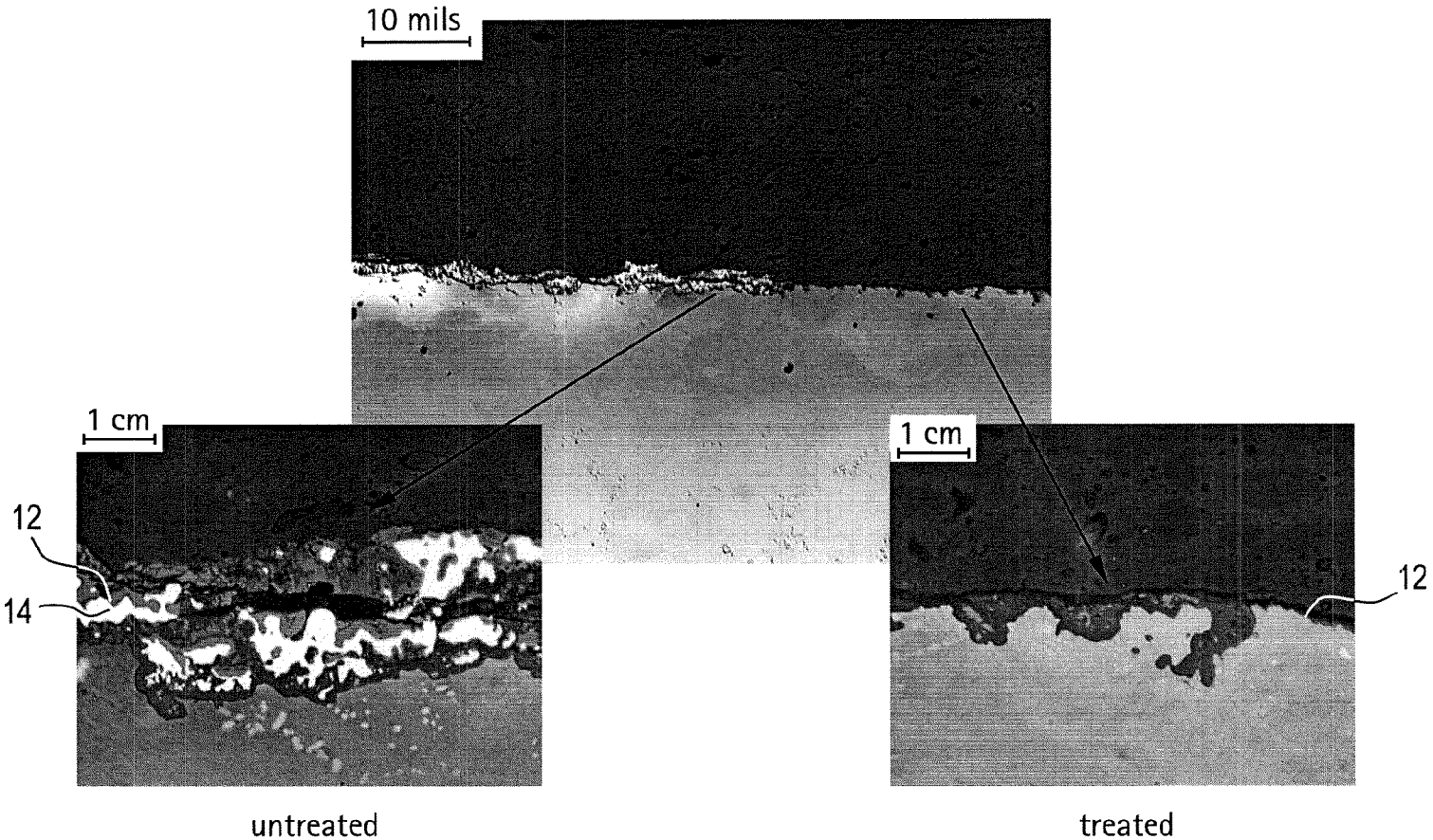
FIG. 6 is a cross-sectional view of a surface of a gas turbine airfoil in which a portion of the surface has been treated.

FIG. 6 illustrates a picture of the first sample with a portion of the surface 12 being untreated, which shows oxide 14, and a portion of the surface being treated as set forth in the example and there is no more oxide along the surface 12.

Some of the preferred embodiments have been set forth in this disclosure for the purpose of illustration. However, the foregoing description should not be deemed to be a limitation on the scope of the invention. Accordingly, various modifications, adaptations, and alternatives may occur to one skilled in the art without departing from the spirit and scope of the claimed inventive concept.

What is claimed:

1. A method of removing oxide from a crack in a substrate, the method comprising:
   applying a slurry paste comprising a fluoride salt to the crack;
   heating the slurry paste and the crack to at least a melting point of the fluoride salt to form a reaction product; and
   removing the reaction product.

2. The method of claim 1, wherein the fluoride salt includes potassium tetraflnoroaluniinate and potassium tetrafluoroborate.

3. The method of claim 1, further comprising before said heating the slurry paste, drying the slurry paste.

4. The method of claim 1, further comprising after said apply the slurry paste, penetrating the slurry paste into the crack.

5. The method of claim 4, wherein said penetrating includes:
   cycling to crack through a vacuum so as to cause trapped air to leave the crack; and
   exposing the crack to atmospheric pressure.

6. The method of claim 1, wherein said removing the reaction product is by immersing the crack in a water bat.

7. The method of claim 1, wherein said heating the slurry paste and the crack is done in an inert atmosphere.

8. The method of claim 7, wherein the inert atmosphere includes argon and vacuum.

9. The method of claim 1, wherein the reaction product includes dissolved oxide.

10. The method of claim 1, wherein the reaction product includes a chemical reaction between the slurry paste and the oxide.

11. The method of claim 1, wherein the substrate is a gas turbine airfoil.

12. A gas turbine airfoil including a crack treated by the method of claim 1.

13. A method of removing oxide from a crack in a substrate, the method comprising:
   reacting oxide in the crack by a molten fluoride salt to form a reaction product; and immersing the crack in a water bath to remove oxide.

14. The method of claim 13, wherein said reacting includes:
   applying a slurry paste of a fluoride salt to the crack;
   heating the slurry paste and the crack to at least a inciting point of the fluoride salt so that the slurry paste reacts with the oxide into a reaction product.

15. The method of claim 13, wherein the molten fluoride salt includes potassium tetrafluoroaluminate and potassium tetrafluoroborate.

16. The method of claim 14, further comprising before said heating the slurry paste, drying the slurry paste.

17. The method of claim 14, further comprising after said applying the slurry paste, penetrating the slurry paste into the crack.

18. The method of claim 17, wherein said penetrating includes:
   cycling the crack through a vacuum so as to cause trapped air to leave the crack; and
   exposing the crack to atmospheric pressure.

19. The method of claim 14, wherein said heating the slurry paste and the crack is done in an inert atmosphere.

20. The method of claim 19, wherein rho inert atmosphere includes argon and vacuum.

21. The method of claim 13, wherein the substrate is a gas turbine airfoil.

22. A method of removing oxide from a crack in a substrate, the method comprising:

applying a slurry paste to the crack, wherein the slurry paste comprises a fluoride salt;

applying a vacuum to the crack;

heating the slurry paste and the crack to at least a melting paint of the fluoride salt to form a reaction product; and removing the reaction product.

23. The method of claim 22, further comprising, after the applying the vacuum to the crack, exposing the crack to atmospheric pressure.

24. The method of claim 22, wherein said removing the reaction product is by immersing the crack in a water bath.

25. The method of claim 22, wherein said heating the slurry paste and the crack is done in an inert atmosphere.

* * * * *

UNITED STATES PATENT AND TRADEMARK OFFICE

CERTIFICATE OF CORRECTION

PATENT NO. : 7,125,457 B2
APPLICATION NO. : 10/749486
DATED : October 24, 2006
INVENTOR(S) : Lawrence B. Kool et al.

It is certified that error appears in the above-identified patent and that said Letters Patent is hereby corrected as shown below:

Column 3, Table 1: delete “salt nam”, and insert therefor --salt name--.

Column 6, Line 14: after “potassium”, delete “tetraflnoroaluniinate” and insert therefor --tetrafluoroaluminate--.
Line 23: after “cycling”, delete “to” and insert therefor --the--.
Line 27: after “water”, delete “bat” and insert therefor --bath--.
Line 49: after “a”, delete “inciting” and insert therefor --melting--.

Column 7, Line 1: after “wherein”, delete “rho” and insert therefor --the--.
Line 11: before “of”, delete “paint” and insert therefor --point--.

Signed and Sealed this

Sixth Day of March, 2007

JON W. DUDAS
*Director of the United States Patent and Trademark Office*